United States Patent [19]

Cash

[11] Patent Number: 4,793,532

[45] Date of Patent: Dec. 27, 1988

[54] CARRIER FOR BALL GAME ITEMS

[76] Inventor: Dennis R. Cash, Box 231, Conway Springs, Kans. 67031

[21] Appl. No.: 83,440

[22] Filed: Aug. 10, 1987

[51] Int. Cl.[4] ..... A45F 3/02

[52] U.S. Cl. ..... 224/202; 206/315.1; 224/919; 383/4

[58] Field of Search ..... 224/919, 202; 206/315.1, 315.3, 315.6; 150/52 A; 190/1, 102, 107, 901; 383/4

[56] References Cited

U.S. PATENT DOCUMENTS

| | | | |
|---|---|---|---|
| 1,203,095 | 10/1916 | Bristow | 206/315.1 |
| 2,047,079 | 7/1936 | MacMurray | 224/202 |
| 2,254,578 | 9/1941 | O'Brien | 190/107 |
| 2,889,863 | 6/1959 | Arnold, Jr. | 206/315.1 |
| 3,313,333 | 4/1967 | Lordi | 383/4 X |
| 3,777,862 | 12/1973 | Zipper | 190/107 |
| 4,227,559 | 10/1980 | Stroman | 206/315.6 |
| 4,420,024 | 12/1983 | Clayton | 206/315.3 X |
| 4,629,065 | 12/1986 | Braaten | 206/315.1 |
| 4,693,402 | 9/1987 | Comeau | 224/919 X |

*Primary Examiner*—Henry J. Recla
*Assistant Examiner*—Robert Petrik
*Attorney, Agent, or Firm*—Kokjer, Kirscher, Bradley, Wharton, Bowman & Johnson

[57] ABSTRACT

A carrier for ball game items such as baseball or softball bats and balls. A removable bottom contains a compartment for containing the balls. A sidewall contains compartments for individual bats. The carrier may be opened to a generally planar configuration to allow it to be coupled with a fence. Hooks are provided for attachment to the fence.

16 Claims, 1 Drawing Sheet

CARRIER FOR BALL GAME ITEMS

BACKGROUND OF THE INVENTION

This invention relates in general to sports equipment and, more particularly, to an item which may be used as a carrier for equipment such as baseball or softball bats and balls.

A well equipped team will often utilize a wide selection of ball bats to accommodate the preferences of the individual members of the team. The team will also use a large number of balls so that the team members may properly warm up before a practice session or a game. Because of the large number of balls and bats required, recreational teams often use a large bag such as a duffel bag to transport these items to and from the playing field. While these bags may prove adequate for transporting the equipment, they are unsatisfactory for holding the bats during a game because of the difficulty in selecting the desired bat from among the number of bats in the bag. Because of this, the bats are often left lying on the ground or leaning against the backstop where they may cause players to trip and injure themselves. This also makes it more difficult to keep track of the bats and they may be lost when the opposing team mistakenly picks one up.

Conventional bags are also of a length which makes it difficult to reach the balls in the bottom of the bag. This is undesirable as the balls are periodically needed for warm-up during a game and they must be kept in an accessible location because of the short amount of time available for warming up each inning. Due to the inconvenience of the bag, the balls are often left lying on the ground where they are difficult to keep track of and where they also present a safety hazard as the players may accidentally trip over them and injure themselves.

SUMMARY OF THE INVENTION

It is an object of this invention to provide a carrier for ball game items which ma also be quickly converted to a holder for the bats and balls so that they may be kept in an organized fashion during a game to allow for quick access when needed.

It is another object of this invention to provide a carrier for ball game items such as bats and balls which contains an easily accessible compartment for holding the balls so that the balls may be retained in the bag, but may be quickly accessed when needed.

It is a further object of this invention to provide a carrier for ball game items such as bats and balls which has a ball compartment as described so that the balls may be kept in the compartment when not in use so as to prevent players from accidentally tripping over the balls and injuring themselves.

It is a still further object of this invention to provide a carrier for ball game items such as bats and balls which has compartments for holding individual bats so that they may be kept in the compartments when not in use to prevent players from accidentally tripping over them and injuring themselves.

To accomplish these and other related objects of the invention, a carrier is provided with a sidewall and a bottom which cooperate to form a generally cylindrical container which is open at the top and closed at the bottom. The bottom is provided with a compartment which may be used for holding a number of balls. A zipper or other means is used for detaching portions of the bottom from the sidewall to provide access to the balls when needed. A plurality of compartments for holding the bats may also be coupled with an inner surface of the sidewall. A zipper may be used for allowing the sidewall to be opened to a generally planar configuration so that it may be coupled with a fence. This allows the bats and balls to be retained in an organized fashion and ensures that players do not injure themselves by tripping over bats or balls lying on the ground.

BRIEF DESCRIPTION OF THE DRAWINGS

Turning now to the drawings where like reference numerals are used to indicate like components in the various views.

DESCRIPTION OF THE PREFERRED EMBODIMENT

Figure 3:
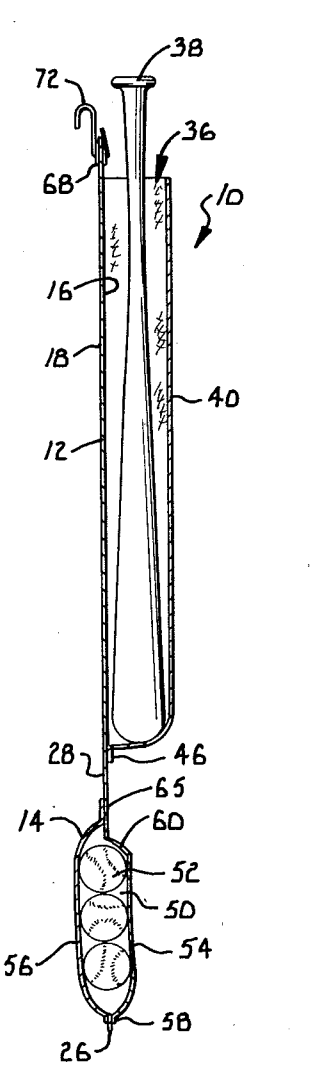
FIG. 3 is a side elevation view in section taken along line 3—3 of FIG. 2.

Turning now to the drawings more particularly, the equipment bag or carrier of the present invention is represented generally by the numeral 10. Carrier 10 comprises a sidewall 12 and a bottom 14 coupled with the sidewall to form a generally cylindrical receptacle which is closed at the bottom and open at the top. Sidewall 12 has interior and exterior surfaces 16 and 18 and a zipper 20 joins sidewall edges 22 and 24 to form the cylindrical shape of the carrier. A second zipper 26 joins a bottom edge 28 of the sidewall with portions of bottom 14 to form the closed bottom of the carrier 10.

The carrier includes an elongated carrying strap 30 which has one end 32 attached to the sidewall adjacent its top edge 33 and another end 34 attached to sidewall 12 adjacent the bottom edge 28. A plurality of compartments 36 for holding individual bats 38 are coupled with the interior surface 16 of sidewall 12. The compartments 36 are closed along their sides and bottom and are open at the top. They are preferably formed from a single piece of material 40 sized slightly smaller than sidewall 12. The material 40 has side edges 42 and 44 and bottom edge 46 which are sewn or coupled by other suitable methods to inner surface 16 of sidewall 12. The individual compartments 36 may then be formed by sewing material 40 to the sidewall along intermediate vertical seams 48. The seams 48 are preferably spaced far enough apart to accommodate bats of various widths.

Figure 2:
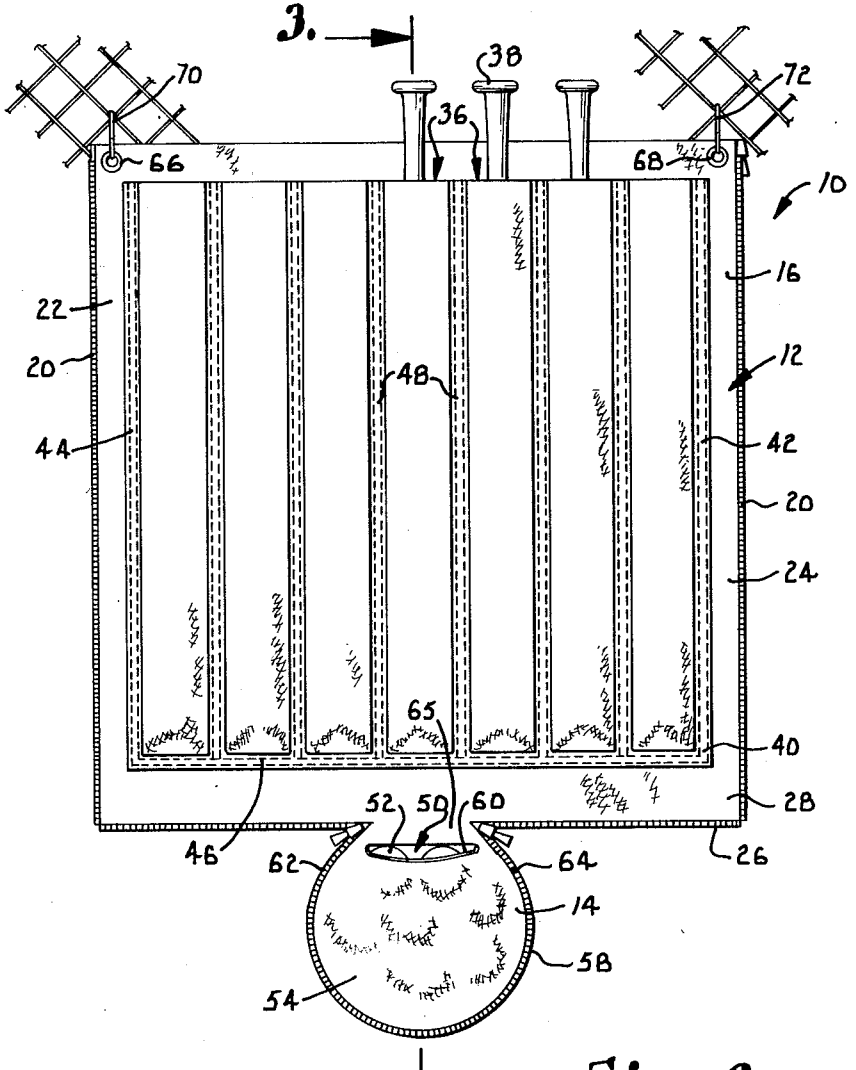
FIG. 2 is a front elevational view of the carrier of FIG. 1 but shown in an open configuration.
Figure 1:
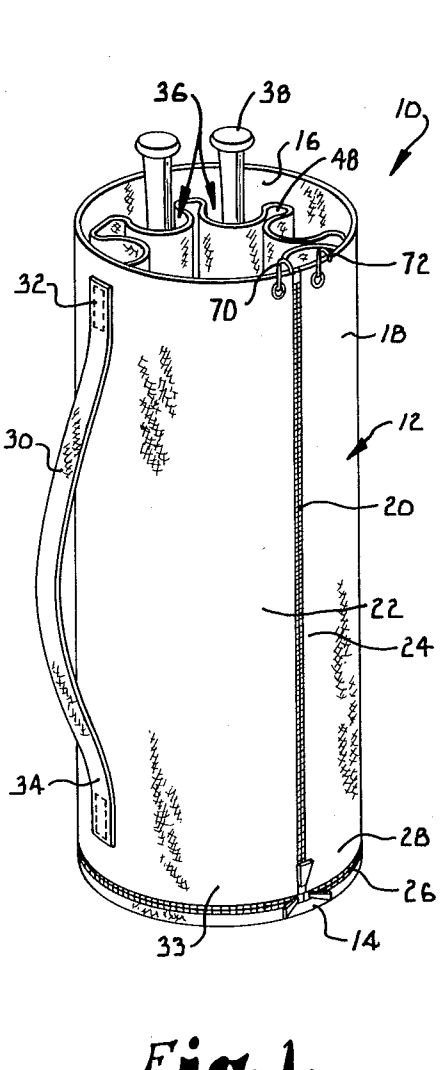
FIG. 1 is a perspective view of a ball and bat carrier of the present invention.

As can best be seen in FIGS. 2 and 3, a compartment 50 for holding balls 52 is formed in the carrier bottom 14. Top and bottom panels 54 and 56 are joined together at their periphery 58 to form the compartment. An opening 60 in the top panel 54 is provided to allow access to the compartment.

The zipper 26 which couples bottom 14 to sidewall 12 is coincident with periphery 58 and comprises portions 62 and 64 which extend around substantially the entire periphery. A portion 65 of bottom 14 is preferably directly attached to sidewall 12 at a position adjacent the opening 60 so that the bottom remains partially attached to the sidewall when the zipper portions are unzipped.

A pair of grommets 66 and 68 are attached to the top of sidewall 12 and are preferably placed adjacent edges 22 and 24. Suitable hooks 70 and 72 are coupled with the grommets to allow the carrier to be removably attached to a chain-link or other type of fence.

In use, the carrier 10 provides a convenient means for transporting bats 38 and balls 52 to and from a ball diamond. The bats are loaded by simply inserting them into individual compartments 36. The balls 52 may be loaded into compartment 50 by simply unzipping zipper portions 62 and 64 to provide access to the compartment opening 60. Once the balls and bats have been loaded into the carrier, the zippers are closed and the strap 30 may be used to transport the carrier.

The carrier 10 also serves the function of a holder for the bats and balls during a game or practice session. When the bats or balls are needed at the ball diamond, easy access to the equipment may be provided by attaching carrier 10 to a fence by first unzipping zippers 20 and 26 to open the carrier to a generally planar configuration. Hooks 70 and 72 may then be coupled with the fence at a height which allows easy access to both the bats and the balls when they are needed.

The partially removable bottom 14 is particularly desirable as it allows the balls to be easily removed from the carrier even when the sidewall zipper 20 is closed. It is important that the compartment opening 60 be located adjacent where the bottom 14 is directly connected to sidewall 12. This ensures that the balls 52 do not fall through the opening when the zippers 20 and 26 are opened and the carrier attached to the fence.

The use of zippers 20 and 26 allows the carrier 10 to be opened to the generally planar configuration. This reduces the profile of the carrier and allows it to be coupled with fences or other objects in areas such as dugouts where available space is often at a premium.

The carrier can thus be used as a holder for the bats and balls so that they may be kept in an organized fashion. In addition to providing a convenient means for keeping track of the equipment, the carrier keeps the bats and balls off of the ground where they might otherwise cause a player to trip and injure himself.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A carrier for ball game items, said carrier comprising:

a sidewall having interior and exterior surfaces and longitudinally extending side edges;

a plurality of elongated compartments coupled with said interior surface of said sidewall and extending between said side edges for holding a ball bat, said compartment having a closed end and an opposite open end;

a bottom having top and bottom panels forming a compartment therebetween for holding balls;

an opening in said top panel of said bottom to allow placement and removal of said balls in said compartment;

first means for releasably coupling said bottom with said sidewall along a portion of a periphery of said bottom; and second means for releasably joining together said sidewall side edges, wherein said bottom and sidewall may be coupled together to form an elongated container which is closed at the bottom and open at the top and wherein said bottom may be detached from said sidewall along a portion of the perimeter of the bottom to provide access to the ball-holding compartment.

2. The invention of claim 1, where said first means comprises a zipper which couples together at least part of the periphery of said bottom with said sidewall.

3. The invention of claim 2, wherein a portion of said bottom remains attached to said sidewall to retain said bottom and sidewall together when said zipper is unzipped.

4. The invention of claim 3, wherein said ball compartment opening is positioned adjacent said portion of said bottom which is attached to said sidewall.

5. The invention of claim 1, wherein said sidewall includes a zipper extending from a top edge to a bottom edge along said side edges and wherein said zipper may be unzipped to allow said sidewall to be opened to a generally planar configuration.

6. The invention of claim 5, wherein said sidewall includes means for releasably coupling the carrier with a fence when said sidewall is opened to said planar configuration.

7. The invention of claim 6, wherein said fence coupling means comprises at least a pair of hooks coupled with said sidewall.

8. A carrier for ball game items, said carrier comprising:

a generally flat sidewall having opposed side edges;

a plurality of elongated compartments coupled with said sidewall and extending between said side edges for holding a bat, said compartments having a closed end and an open opposite end;

means for releasably coupling said side edges together;

a bottom having a compartment for holding one or more balls; and means for releasably coupling said bottom with a bottom edge of said sidewall, wherein said bottom and sidewall may be coupled together to form a generally cylindrical container which is closed at the bottom and open at the top and wherein said carrier may also be opened to a generally planar configuration.

9. The invention of claim 8, wherein said bottom includes an opening to providing access to th ball-holding compartment.

10. The invention of claim 9, wherein said bottom coupling means comprises a zipper which couples together at least part of the periphery of the bottom and bottom edge.

11. The invention of claim 10, wherein a portion of said bottom is attached to said bottom edge to retain said bottom and sidewall together when said zipper is unzipped.

12. The invention of claim 11, wherein said ball-holding compartment opening is positioned adjacent said bottom portion which is attached to said bottom edge.

13. The invention of claim 8, wherein said carrier includes means for removably coupling the carrier with a fence.

14. The invention of claim 13, wherein said means includes hooks coupled with said sidewall.

15. The invention of claim 8, wherein said bottom comprises a top and a bottom panel which are coupled at their periphery to form said ball compartment.

16. The invention of claim 8, wherein said side edges coupling means comprises a zipper extending from a top edge of the sidewall to a bottom edge of the sidewall.

* * * * *